US006786707B2

(12) United States Patent
Kim

(10) Patent No.: US 6,786,707 B2
(45) Date of Patent: Sep. 7, 2004

(54) STRUCTURE FOR REDUCING NOISE AND VIBRATION OF SCROLL COMPRESSOR

(75) Inventor: Young Gi Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/034,377

(22) Filed: Jan. 3, 2002

(65) Prior Publication Data

US 2003/0021706 A1 Jan. 30, 2003

(30) Foreign Application Priority Data

Jul. 27, 2001 (KR) ..... 2001-45518

(51) Int. Cl.[7] ..... F04B 39/12
(52) U.S. Cl. ..... 417/363
(58) Field of Search ..... 417/363, 902

(56) References Cited

U.S. PATENT DOCUMENTS 3,317,121 A * 5/1967 De Groat ..... 417/363
3,445,059 A * 5/1969 Hannibal et al. ..... 417/363
3,448,918 A * 6/1969 Cawley ..... 417/363
3,462,075 A * 8/1969 Dirk et al. ..... 417/363
4,174,189 A * 11/1979 Elson ..... 417/363
4,544,334 A * 10/1985 Ellis ..... 417/363
5,980,222 A * 11/1999 Fry ..... 417/553
6,289,776 B1 * 9/2001 Altstadt et al. ..... 82/1.11

FOREIGN PATENT DOCUMENTS

GB 2032004 * 4/1980
JP 3-96693 * 4/1991

* cited by examiner

*Primary Examiner*—Michael Koczo
(74) *Attorney, Agent, or Firm*—Birch, Stewart, Kolasch & Birch, LLP

(57) ABSTRACT

A structure for reducing noise and vibration in a scroll compressor includes an outer casing connected with a suction pipe and a discharge pipe respectively. The scroll compressor also includes an inner casing combined with the inner circumferential surface of the outer casing, a driving motor combined with the inner circumferential surface of the inner casing for generating a rotational force, a driving shaft combined with a rotor for transmitting the rotational force, a fixed scroll for forming a plurality of compression pockets which continuously move and which is combined with an orbiting scroll orbiting eccentrically with the driving shaft. A frame affixed on the inner circumferential surface of the inner casing for supporting the driving shaft and an elastic supporting device for elastically supporting both ends of the outer casing and inner casing can efficiently reduce noise and vibration generated in the whole compressor by attenuating the noise and vibration generated during the compression of the refrigerant gas.

1 Claim, 5 Drawing Sheets

STRUCTURE FOR REDUCING NOISE AND VIBRATION OF SCROLL COMPRESSOR

BACKGROUND OF THE INVENTION

1. Field of the Invention

The present invention relates to a structure for reducing noise and vibration in a scroll compressor, and more particularly to a suction head of a structure for reducing noise and vibration in a scroll compressor capable of reducing noise and vibration generated when driving the compressor by separately assembling a vibration unit and a compression unit from a casing.

2. Description of the Background Art

Generally, a compressor changes mechanical energy into latent energy of a compressive fluid and conventionally is classified into reciprocating-type, scroll-type, centrifugal-type and vane-type compressors. Among these compressors, the scroll-type compressor draws in, compresses and discharges gas using a rotary element, e.g., as in the centrifugal-type or vane-type compressors. In contrast, the reciprocating-type compressor uses a linear reciprocating movement of a piston.

FIG. 1 is a longitudinal sectional view showing an example of a conventional scroll compressor of the background art. The conventional scroll compressor includes a casing 1 filled with oil to a certain height; a main frame 2 and sub frame 3 which are fixed at upper and lower sides of the inner circumferential surface of the casing 1; a driving motor which is positioned between the main frame 2 and sub frame 3 and having a stator 4A and rotor 4B; a driving shaft 5 pressed at the center portion of the rotor 4B of the driving motor 4 for transmitting a driving force generated in the driving motor 4 and penetrating the main frame 2; an orbiting scroll 6 placed on the upper surface of the main frame 2 and combined with the driving shaft 5; a fixed scroll 7 combined with the orbiting scroll 6 and fixed on the upper surface of the main frame 2 to form a plurality of compression pockets; a high/low pressure separation plate 8 combined with the rear surface of the fixed scroll 7 for dividing the inner portion of the main frame 2 into a suction pressure area and a discharge pressure area; and a non-return valve assembly 9 combined with the rear surface of the fixed scroll 7 for preventing a reverse flow of discharged refrigerant gas.

The casing 1 has a suction pipe (SP) at one side and a discharge pipe (DP) at the other side centering around the high/low pressure separation plate 8. Accordingly, the suction pipe (SP) is connected to a suction pressure area and the discharge pipe (DP) is connected to a discharge pressure area. The main frame 2 and the sub frame 3 are all fixed on the inner circumferential surface of the casing 1 by the method of welding and the fixed scroll 7 is secured on the lower surface of the high/low pressure separation plate 8.

Wraps 6A and 7A are formed on the corresponding surfaces of the orbiting scroll 6 and fixed scroll 7. The wraps 6A and 7A mesh with each other and continuously move to form an involute curve and a plurality of compression pockets. In the drawings, undescribed reference numeral 7*b* designates a suction port, 7*c* designates a discharge port and O designates an oil feeder.

Hereinafter, the operation of the conventional scroll compressor with the above construction will be described as follows. First, when power is applied to the stator 4A of the driving motor 4, the rotor 4B rotates with the driving shaft 5 at the inner side of the stator 4A and the orbiting scroll 6 orbits over an eccentric distance. At the same time, a wrap 6*a* of the orbiting scroll 6 forms a plurality of compression pockets between itself and the wrap 7*a* of the fixed scroll 7 and the compression pocket moves to the center side of the scrolls by the continuous orbiting movement of the orbiting scroll 6. The compression pocket draws in, compresses and discharges refrigerant gas as the volume of the pocket is reduced.

However, in the conventional scroll compressor, the driving shaft 5 for transmitting a power of the vibration unit to a compressing unit is combined with the main frame 2 and sub frame 3 and vibration of the compression unit is transmitted to the exterior of the casing 1. Accordingly, noise and vibration are generated as the main frame 2 and the sub frame 3 are abutted with or in contact with the casing 1.

Also, a portion of the casing 1 forms a discharge chamber together with the high/low pressure separation plate 8. However, in this case, the refrigerant gas with high pressure collides with the casing 1 and increases vibration and noise. Since the discharge pipe (DP) is directly connected to the discharge chamber, e.g., composed of the casing 1 and high/low pressure separation plate 8, vibration and noise caused by the high pressure discharge gas cannot be reduced.

SUMMARY OF THE INVENTION

Therefore, the present invention provides a structure for reducing noise and vibration of a scroll compressor with low noise and vibration by reducing vibration of a compressing unit and vibration unit transmitted to an exterior of a casing.

To achieve these and other advantages and in accordance with the purpose of the present invention, as embodied and broadly described herein, there is provided a structure for reducing noise and vibration of a scroll compressor including an outer casing connected-combined with a suction pipe and discharge pipe respectively, an inner casing combined with the inner circumferential surface of the outer casing, a driving motor combined with the inner circumferential surface of the inner casing, for generating a rotation force, a driving shaft combined with a rotor for transmitting the rotation force, a fixed scroll for forming a plurality of compression pockets which continuously move, combined with an orbiting scroll orbiting eccentrically combined with the driving shaft and the orbiting scroll and forming a discharge port, a frame fixed-combined on the inner circumferential surface of the inner casing, for supporting the driving shaft and an elastic supporting means for elastically supporting both ends of the outer casing and inner casing.

One or more of these and other aspects of the present invention are accomplished by a structure for reducing noise and vibration in a scroll compressor, comprising an outer casing operatively connected with a suction pipe and discharge pipe; an inner casing engaged with an inner circumferential surface of the outer casing; a driving motor engaged with the inner circumferential surface of the inner casing for generating a rotational force; a driving shaft engaged with a rotor for transmitting the rotational force; a fixed scroll forming a discharge port, and arranged with an orbiting scroll so as to have a plurality of compression pockets, said orbiting scroll eccentrically engaged with the driving shaft, wherein said compression pockets continually move during an orbital motion of said orbiting scroll; a frame affixed on the inner circumferential surface of the inner casing for supporting the driving shaft; and an elastic support device positioned between said inner casing and said outer casing for elastically supporting ends of the outer casing and the inner casing, wherein said elastic support device is positioned at a predetermined height of said inner casing corresponding to an imaginary line passing perpendicular to said driving shaft, wherein said imaginary line passes through said frame, said driving shaft and said elastic support device.

The foregoing and other, features, aspects and advantages of the present invention will become more apparent from the following detailed description when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Figure 1:
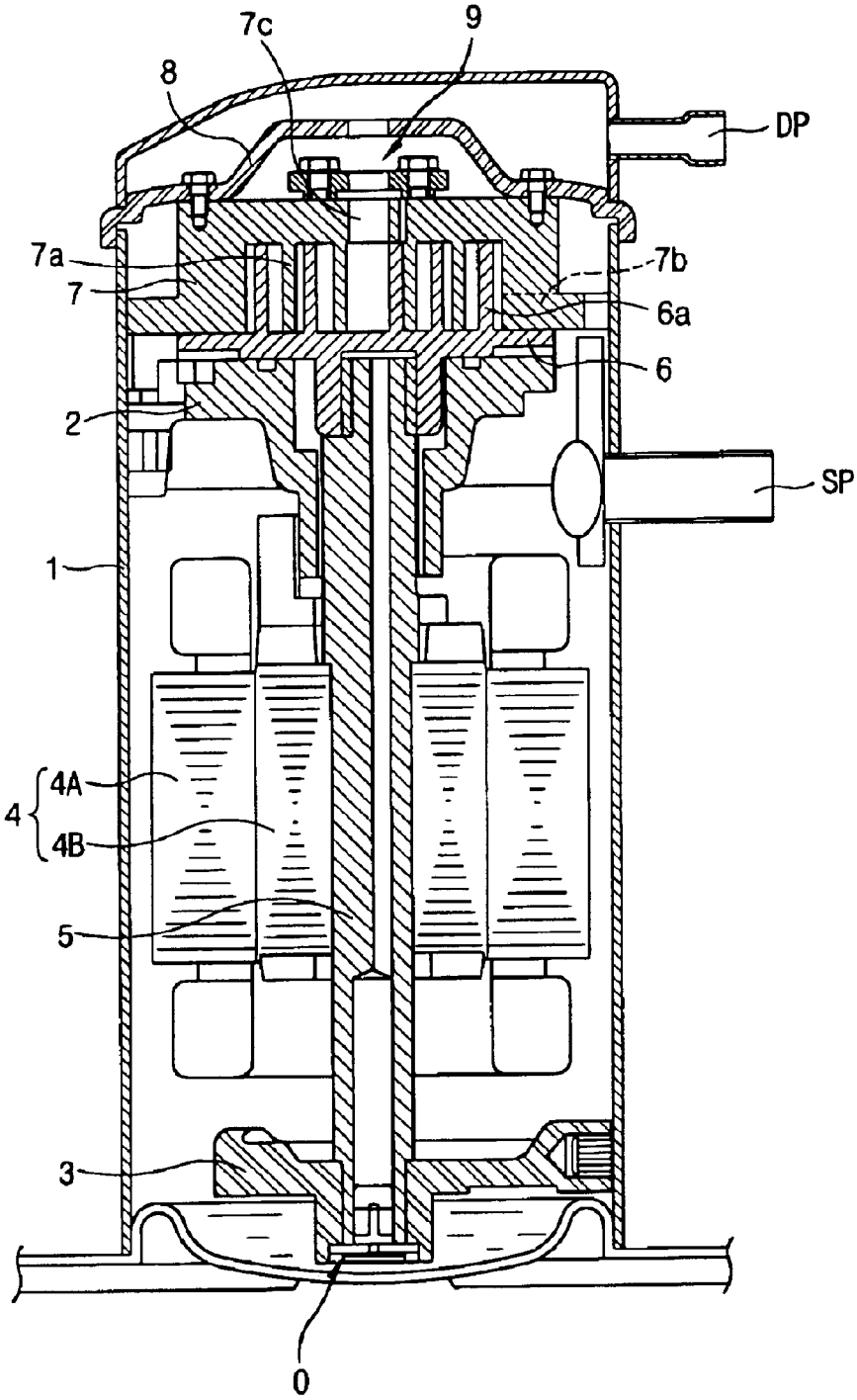
FIG.1 CONVENTIONAL ART
FIG. 1 is a longitudinal sectional view showing an example of a conventional scroll compressor.
Figure 2A:
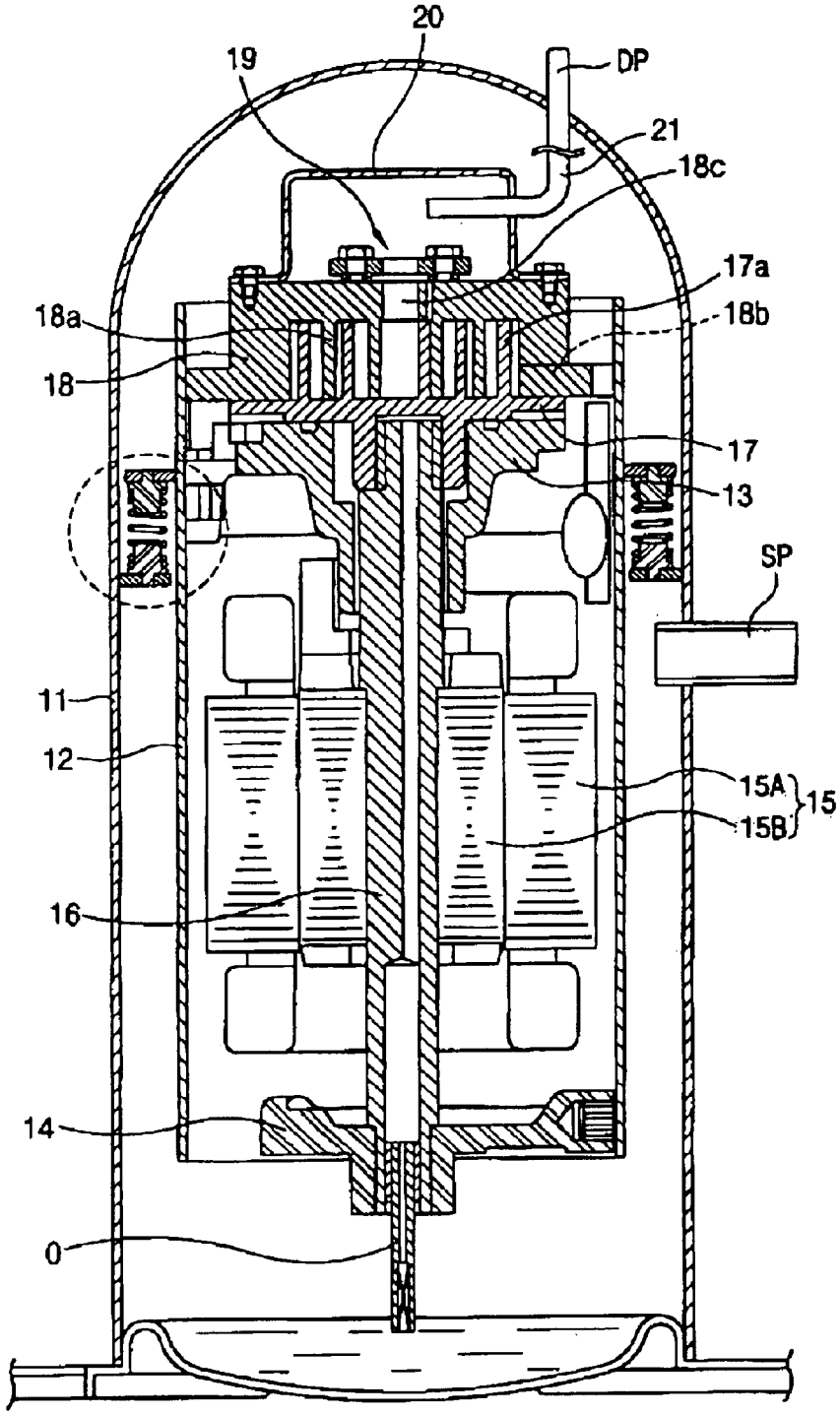
FIGS. 2(A) and 2(B) are longitudinal sectional views showing an example of a structure for reducing noise and vibration of a scroll compressor in accordance with the present invention.
Figure 2B:
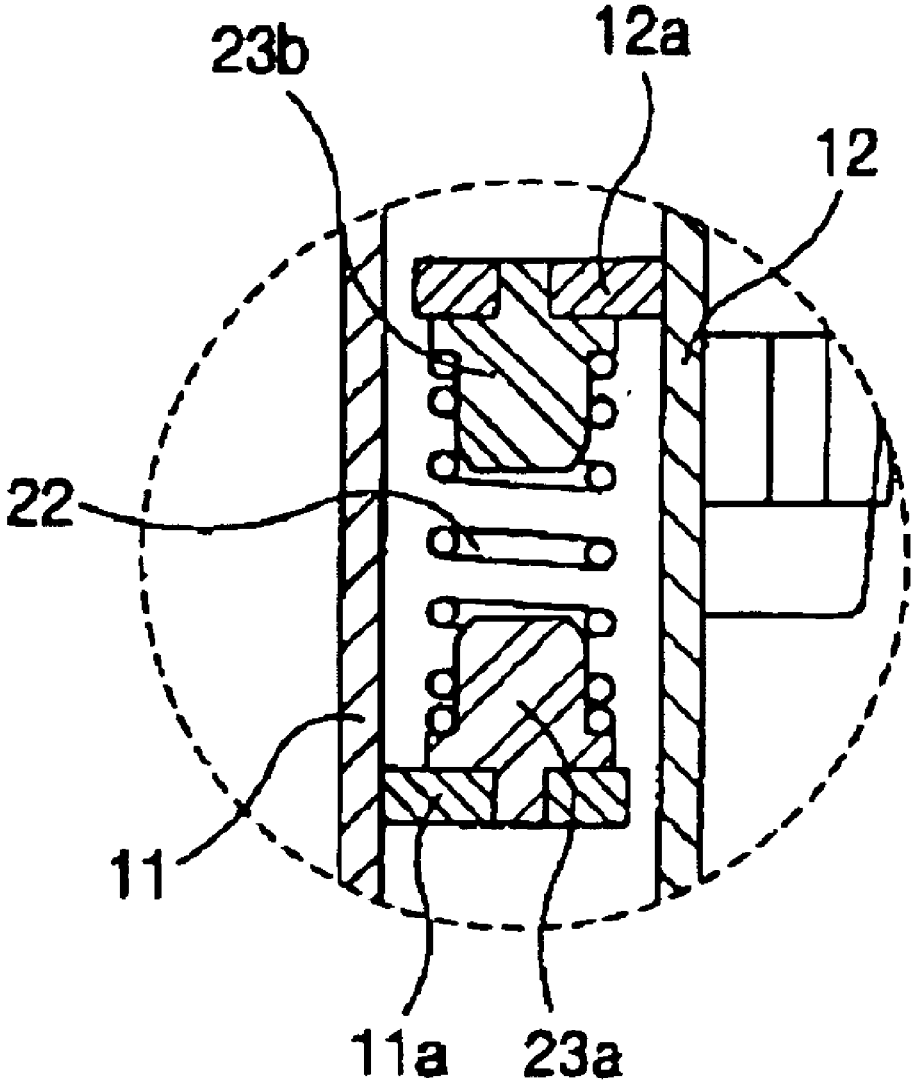

Reference will now be made in detail to the preferred embodiments of the present invention, examples of which are illustrated in the accompanying drawings. Reference numerals, which are the same as the afore-mentioned background art, designate the same reference numeral and a duplicate description will be omitted hereinafter.

The scroll compressor in accordance with the present invention includes an outer casing 11 connected to a suction pipe (SP) and discharge pipe (DP) and filled with oil to a certain height; an inner casing 12 elastically supported in the outer casing 11; a main frame 13 and sub frame 14 which are fixed at upper and lower sides of the inner circumferential surface of the inner casing 12; a driving motor 15 which is positioned between the main frame 13 and sub frame 14 being composed of a stator 15A and rotor 15B; a driving shaft 16 pressed at the center portion of the rotor 15B of the driving motor 15 for transmitting a driving force generated in the driving motor 15 and penetrating the main frame 13; an orbiting scroll 17 placed on the upper surface of the main frame 13 combined with the driving shaft 16; a fixed scroll 18 combined with the orbiting scroll 17 and fixed on the upper surface of the main frame 13 to form a plurality of compression pockets; a non-return valve assembly 19 combined to accommodate the discharge port 18*c* of the fixed scroll 18 for preventing a reverse flow of the compressed refrigerant gas; a discharge plenum 20 combined on the rear surface of the fixed scroll 18 to accommodate the non-return valve assembly 19; and a loop pipe 21 having an end connected to the discharge plenum 20 and the other end connected to the discharge pipe of the outer casing 11.

At least three outer supporting protrusion portions 11*a* are formed having a same height on the inner circumferential surface and at least inner supporting protrusion portions 12*a* are formed at a position on a perpendicular line opposed to the outer supporting protrusion portion 11*a* on the outer circumferential surface of the inner casing 12.

Spring fixing members 23*a* and 23*b* are inserted and engaged with the outer supporting protrusion portion 11*a* and the inner supporting protrusion portion 12*a* and an elastic member composed of the coil spring 22 for electrically supporting the inner casing 12 on the outer casing 11 is positioned on the opposed surface of the spring fixing member 23*a* and 23*b*.

Hereinafter, a modified embodiment of the structure for reducing noise and vibration of the scroll compressor in accordance with the present invention will be described with reference to the accompanying drawings.

Figure 3:
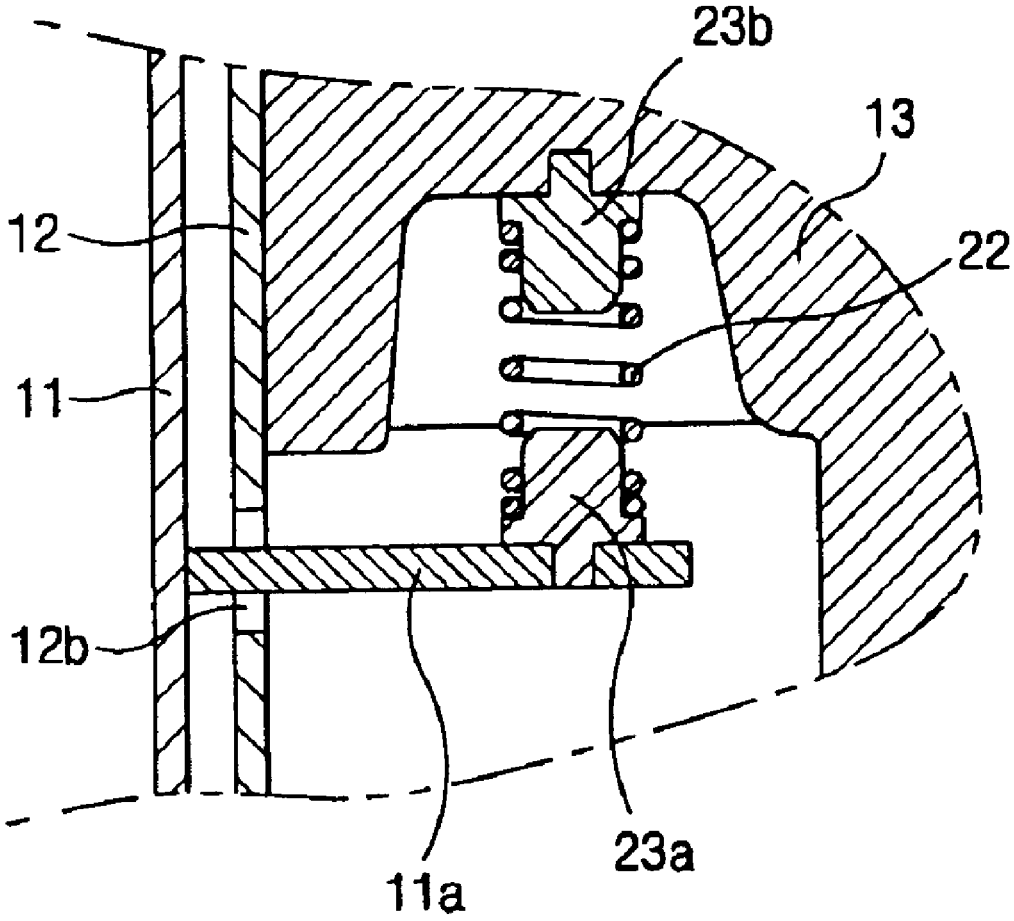
FIG. 3 is a modified example and main portion of the structure for reducing noise and vibration of the scroll compressor in accordance with the present invention.
Figure 4:
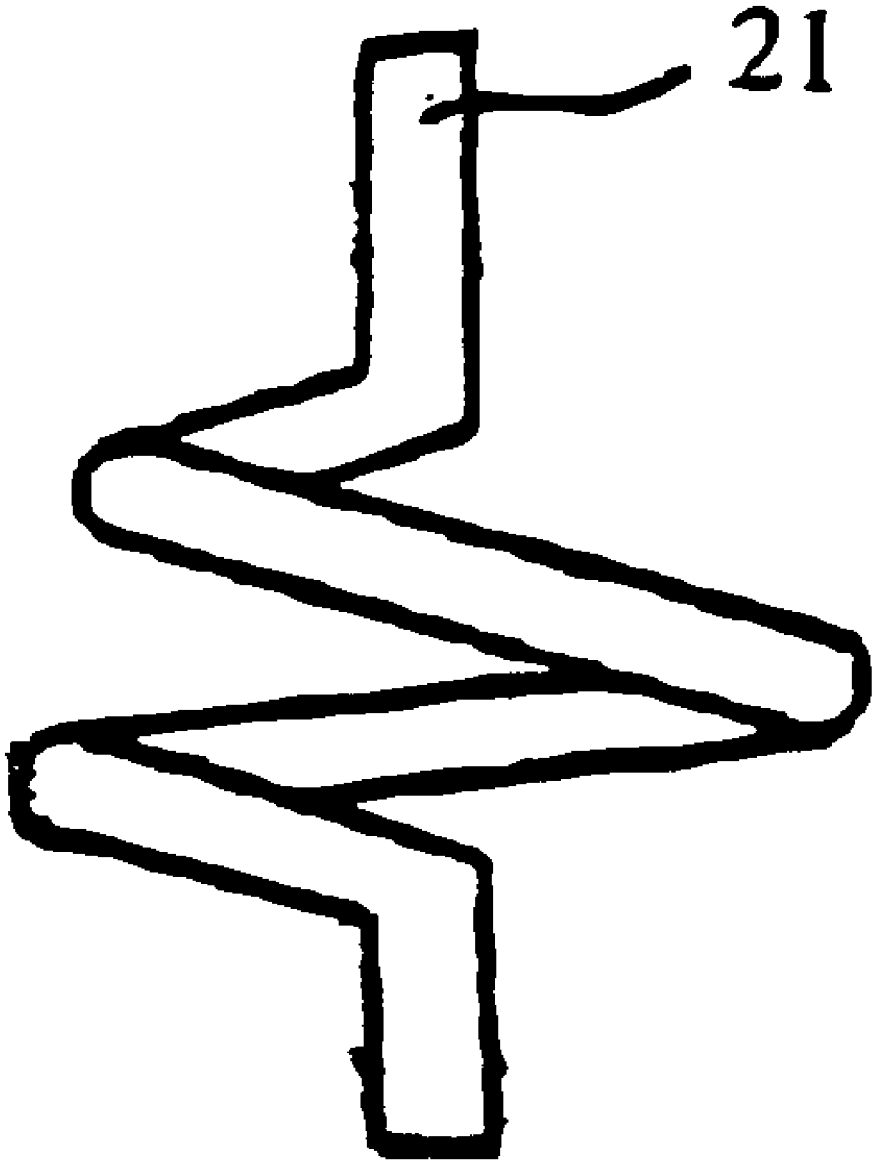
FIG. 4 is a partial side view of a loop pipe according to an embodiment of the scroll compressor of the present invention.

First, as shown in FIG. 3, a plurality of elastic mounting holes 12*b* are formed having a same height at a certain portion of the inner casing 12 and the outer supporting protrusion portions 11*a* are combined with the inner circumferential surface of the outer casing 11 penetrating the elastic mounting holes 12*b*. A plurality of spring fixing members 23*a* are secured at a side of the outer supporting protrusion portion 11*a*.

Then, a plurality of spring fixing members 23*b* are attached having a same height in a certain portion of the main frame 13 and an elastic member composed of a compression coil spring for supporting the inner casing 12 on the outer casing 11 is positioned on the opposed surface between the plurality of spring fixing members 23*b* and spring fixing members 23*a* to reduce the outer diameter of the whole compressor.

Although not shown in the drawings, one of skill in the art will appreciate that the inner casing 12 can be supported by hanging the upper end on the outer casing 11 or supporting the lower surface of the inner casing 12 with the bottom surface of the outer casing 11. It is desirable that the inner casing 12 has a lower end that is elastically supported having a certain height difference from the bottom surface of the outer casing 11.

Also, it is desirable that the lower end of the driving shaft 16 is at least formed longer than the lower end of the inner casing 12 to attenuate vibration generated when oil is sucked up with an oil feeder O. The discharge plenum 20 can be formed by continuously connecting a plurality of discharge spaces horizontally or vertically.

Also, it is desirable that the loop pipe 21 is formed as a spring pipe to set off the vibration generated in compressing and discharging and bound in various forms between the outer casing 11 and the inner casing 12 to absorb vibration by itself. More desirably, it is desirable that the loop pipe 21 is connected to the discharge pipe after being secured without engaging the inner circumferential surface of the outer casing 11. Undescribed reference numerals 17*a* and 18*a* are wraps of respective scrolls.

The operation and effect of the structure for reducing noise and vibration of the scroll compressor in accordance with the present invention will be described in greater hereinafter. First, when power is applied to the stator 15A of the driving motor 15, the orbiting scroll 6 orbits across an eccentric distance as the rotor 15B rotates together with the driving shaft 16 at the inner side of the stator 15A. A wrap 17*a* of the orbiting scroll 17 forms a plurality of compression pockets which are composed of pairs between the wrap 17*a* and the wrap 18*a* of the fixed scroll 18 by performing orbiting movement at a distance of the orbiting diameter centering around the shaft center by the oldham's coupling (no reference numeral). The compression pocket moves to the center side of the scrolls by the continuous orbiting movement of the orbiting scroll 17. Accordingly, a volume of the scroll is reduced and the refrigerant gas that is drawn in and compressed is discharged after the gas consecutively passes the discharge plenum 20, loop pipe 21 and discharge pipe (DP).

At this time, under the condition that the orbiting scroll 17 is meshed with the fixed scroll 18, vibration is generated during the compression of the refrigerant gas by the orbiting movement. However, as the main frame 13 supporting the orbiting scroll 17 and fixed scroll 18 are fixed on the inner casing 12 and the inner casing 12 is elastically supported by the elastic member, e.g., such as the compression coil spring 22, the vibration generated while compressing the refrigerant gas is prevented from being absorbed by the compression coil spring between the inner casing 12 and outer casing 11 and being attenuated and transmitted to the outer casing 11.

On the other hand, in the process where the compressed refrigerant gas is discharged from the compression pocket to the discharge plenum 20, vibration by a pulsation pressure of the refrigerant gas is generated, but the vibration is attenuated at the discharge plenum 20 to reduce the whole compressor vibration.

Particularly, in the case of forming the discharge space of the discharge plenum 20 into many spaces, the compressed refrigerant gas passes respective discharge spaces and is attenuated to reduce noise of the compressor. Also, the loop pipe 21 is positioned between the discharge plenum 20 and the discharge pipe (DP). The loop pipe 21 can have its own elasticity and be bound on the outer diameter of the inner casing 12 or be combined by binding itself.

Therefore, in the structure for reducing noise and vibration of the scroll compressor in accordance with the present invention, the vibration generated in compressing the refrigerant gas is attenuated by the elastic member between the inner casing and outer casing by fixing the compressing unit and the vibration unit on the inner casing and combining the outer casing to the outer side of the inner casing to be elastically supported.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A structure for reducing noise and vibration in a scroll compressor, comprising:

an outer casing operatively connected with a suction pipe and discharge pipe;

an inner casing engaged with an inner circumferential surface of the outer casing;

a driving motor engaged with the inner circumferential surface of the inner casing for generating a rotational force;

a driving shaft engaged with a rotor for transmitting the rotational force;

a fixed scroll forming a discharge port, and arranged with an orbiting scroll so as to have a plurality of compression pockets, said orbiting scroll eccentrically engaged with the driving shaft, wherein said compression pockets continually move during an orbital motion of said orbiting scroll;

a frame affixed on the inner circumferential surface of the inner casing for supporting the driving shaft; and an elastic support device for elastically supporting ends of the outer casing and the inner casing, wherein a lower end of the driving shaft is formed longer than a lower end of the inner casing.

* * * * *